US009254018B2

(12) United States Patent
Bliss

(10) Patent No.: US 9,254,018 B2
(45) Date of Patent: Feb. 9, 2016

(54) SHOE WITH AUTOMATIC CLOSURE MECHANISM

(71) Applicant: Derrick Bliss, West Babylon, NY (US)

(72) Inventor: Derrick Bliss, West Babylon, NY (US)

( * ) Notice: Subject to any disclaimer, the term of this patent is extended or adjusted under 35 U.S.C. 154(b) by 112 days.

(21) Appl. No.: 14/276,250

(22) Filed: May 13, 2014

(65) Prior Publication Data

US 2014/0338225 A1 Nov. 20, 2014

Related U.S. Application Data

(60) Provisional application No. 61/823,294, filed on May 14, 2013.

(51) Int. Cl.

| | |
|---|---|
| ***A43B 11/00*** | (2006.01) |
| ***A43C 11/00*** | (2006.01) |
| ***A43B 3/24*** | (2006.01) |
| ***A43B 1/00*** | (2006.01) |
| ***A43C 11/16*** | (2006.01) |
| ***A43B 3/00*** | (2006.01) |

(52) U.S. Cl.

CPC ..... *A43C 11/00* (2013.01); *A43B 1/0054* (2013.01); *A43B 3/0015* (2013.01); *A43B 3/248* (2013.01); *A43B 11/00* (2013.01); *A43C 11/008* (2013.01); *A43C 11/16* (2013.01)

(58) Field of Classification Search

CPC ..... A43C 11/008; A43C 11/00; A43C 11/12; A43C 11/20; A43C 11/16; Y10T 24/2183; A43B 3/248; A43B 3/00; A43B 3/0015; A43B 23/0295; A43B 1/0054; A43B 3/26

USPC ..... 36/83, 100, 101, 138, 50.1, 97, 8.4

See application file for complete search history.

(56) References Cited

U.S. PATENT DOCUMENTS

| | | | | | |
|---|---|---|---|---|---|
| 3,019,533 | A * | 2/1962 | Smith | A43B 3/128 | 36/7.6 |
| 3,058,241 | A * | 10/1962 | Rigsby | A43B 3/26 | 36/11 |
| 3,430,303 | A * | 3/1969 | Wakefield | A43C 7/00 | 24/269 |
| 3,584,402 | A * | 6/1971 | Silverman | A61F 13/043 | 36/11.5 |
| 3,681,860 | A * | 8/1972 | Bidegain | A43B 3/30 | 36/112 |
| 4,599,811 | A * | 7/1986 | Rousseau | A43B 3/106 | 36/105 |
| 5,205,055 | A * | 4/1993 | Harrell | A43B 5/1633 | 36/50.1 |
| 5,456,027 | A * | 10/1995 | Tecchio | A43B 1/0054 | 280/612 |
| 5,791,068 | A * | 8/1998 | Bernier | A43B 1/0072 | 36/50.1 |
| 5,839,210 | A * | 11/1998 | Bernier | A43B 1/0072 | 36/138 |
| 6,032,387 | A * | 3/2000 | Johnson | A43C 1/06 | 36/118.1 |
| 6,427,361 | B1 * | 8/2002 | Chou | A43B 11/00 | 36/138 |

(Continued)

*Primary Examiner* — Jila M Mohandesi
*Assistant Examiner* — Katharine Gracz
(74) *Attorney, Agent, or Firm* — Sean R. Wilsusen, Esq.

(57) ABSTRACT

Provided is an automated shoe closure including a sole and a plurality of motors disposed in the sole. The motors are configured to expand or contract one or more shoe panels. The shoe panels each include one or more connectors configured to connect the shoe panels to each other when the shoe panels are in an expanded state. A plurality of slits are disposed in the sole. Each of the slits is configured to expand and contract a corresponding shoe panel therethrough. An expansion button is disposed in the sole. A retraction button is disposed in a side of the sole, and a charging port is disposed in the sole.

17 Claims, 2 Drawing Sheets

(56) References Cited

U.S. PATENT DOCUMENTS 6,467,194 B1 * 10/2002 Johnson ..... A43C 1/06 36/118.1
7,721,468 B1 * 5/2010 Johnson ..... A43C 1/06 36/118.1
7,739,808 B2 * 6/2010 Cotton ..... A43B 3/106 36/11.5
7,752,774 B2 * 7/2010 Ussher ..... A43B 3/0005 36/100
8,046,937 B2 * 11/2011 Beers ..... A43B 3/0005 24/68 SK
8,522,456 B2 * 9/2013 Beers ..... A43B 3/0005 24/68 SK
8,935,860 B2 * 1/2015 Torres ..... A43B 3/0005 36/138
2008/0086911 A1 * 4/2008 Labbe ..... A43B 11/00 36/50.1
2009/0272007 A1 * 11/2009 Beers ..... A43C 1/06 36/50.1
2010/0146683 A1 * 6/2010 Laniado ..... A63C 11/00 2/243.1
2010/0251562 A1 * 10/2010 Barrick ..... A43B 3/16 36/7.6
2013/0104429 A1 * 5/2013 Torres ..... A43B 3/0005 36/136

* cited by examiner

SHOE WITH AUTOMATIC CLOSURE MECHANISM

CROSS-REFERENCE TO RELATED APPLICATION

This application claims priority from U.S. Provisional Patent Application No. 61/823,294, filed May 14, 2013, the entire contents of which are incorporated by reference herein.

TECHNICAL FIELD

The present invention relates generally to a shoe or other footwear with an automated closure mechanism which is activated without the use of the user's hands by activating the closure mechanism through an interaction between the user's foot and the sole of the shoe or footwear. The disclosed shoe and automatic closure mechanism operates through a series of motors which manipulate retractable leather, textile or other material making up said shoe. The material making up the shoe can be rolled up or otherwise retracted into the sole of the shoe, thus allowing a user to easily put on or take off the shoe without bending down to reach the height of the user's feet.

The disclosed shoe and automatic shoe closure mechanism has particular application for types of shoes that are inherently difficult to attach to a user's foot, such as formal leather shoes with rigid sides and narrow laces. Additionally, the disclosed shoe and automatic closure mechanism has application to user's who lack the motor skills required to attach a shoe to a foot, in particular, children, the elderly and individuals who have suffered injuries or illness causing immobilization or a lack of motor skills in their hands, legs, feet or back. Further, the disclosed shoe and automatic closure mechanism can particularly assist individuals with limited mobility by preventing injuries from occurring by utilizing hands-free operation of the automatic closure mechanism described herein.

Discussion of Related Art

There are a wide variety of standard attachment mechanisms for uses in different styles of shoes and other footwear. For example, laces, Velcro, leather straps, metal straps, hooks, and the like. Attempts have been made in the past to create automatic closure mechanisms for footwear with limited success, including automatic lace tightening systems and the like. However, none of the existing shoe closure mechanisms allow a user to effortlessly place their feet into the appropriate locations of the top of a sole of the shoe or footwear and automatically attach said footwear automatically without any involvement of the user's hands.

There exists a need for an automatic shoe closure system that allows a user to both properly place their foot in a shoe and attach the shoe to the user's foot securely and then later remove the same shoe without the use of the user's hands.

SUMMARY

Exemplary embodiments of the present invention provide a shoe and automatic shoe closure mechanism which allows a user to both place a shoe about their foot and securely attach and later remove said shoe in a hands-free format.

BRIEF DESCRIPTION OF THE DRAWINGS

Various illustrative embodiments of the present disclosure are described herein with reference to the drawings, wherein.

DETAILED DESCRIPTION

Figure 1:
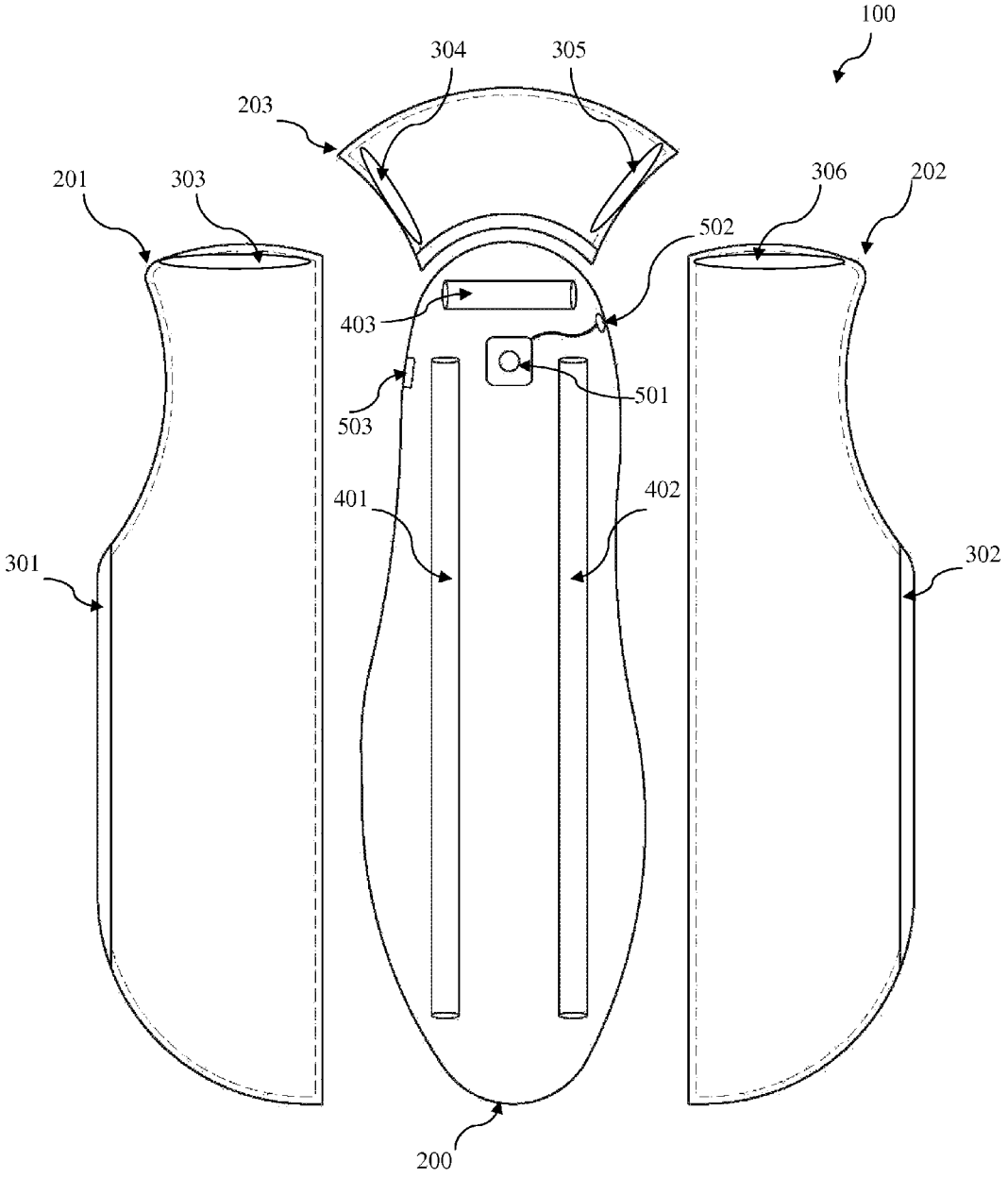
FIG. 1 is a bottom view of an exemplary embodiment of the present invention showing the underside of the sole of footwear and the relative locations of motors, panels, buttons and charging port.

FIG. 1 is a bottom view of an exemplary embodiment of the present invention showing the underside of the sole of footwear and the relative locations of motors, panels, buttons and charging port.

Referring to FIG. 1, an exemplary embodiment of an article of footwear is shown with a bottom perspective of shoe 100. FIG. 1 shows footwear sole 200, two side footwear fabric panels 201 and 202 with exemplary cutouts/contours, rear footwear fabric panel 203 with exemplary cutouts/contours, connectors 301 and 302, 303, 304, 305 and 306, lateral motors 401 and 402, rear motor 403, center expansion activation button 501, lateral retraction activation button 502 and charging port 503.

Referring to FIG. 1, side panels 201 and 202 and rear panel 203 may expand outward by being unwound by motors 401, 402 and 403, respectively. Panels 201, 202 and 203 may include any material of appropriate durability to be made into footwear; such as leather, cotton, nylon or the like. Panels 201, 202 and 203 may be shaped and dimensioned such that they can be associated with motors 401, 402 and 403 by being wrapped around motors 401, 402 and 403. Panels 201, 202 and 203 may be shaped and dimensioned with appropriate cutouts and contours such that panels 201, 202 and 203 may fit together to form the outer and inner layer of a shoe or footwear that can be worn about a user's foot upon complete expansion from sole 200.

Referring to FIG. 1, motors 401, 402 and 403 may be cylindrical in shape, such that they can be attached to panels 201, 202 and 203 for winding and unwinding of panels 201, 202 and 203. Motors 401, 402 and 403 may operate by rotating in a first direction to retract panels 201, 202 and 203 into sole 200 by wrapping panels 201, 202 and 203 around motors 401, 402 and 403, respectively. Motors 401, 402 and 403 further operate by rotating in a second direction opposite to the first direction to expand panels 201, 202 and 203 by unwrapping panels 201, 202 and 203 from motors 401, 402 and 403, respectively.

Referring to FIG. 1, activation button 501 is may be activated upon being depressed by pressure applied by the bottom of the user's foot. Upon the pressing down of button 501, motors 401, 402 and 403 may be activated simultaneously. Motors 401, 402 and 403 may, upon activation, fully and automatically rotate to expand panels 201, 202 and 203 completely out of the sole of the shoe. Upon complete expansion, panels 201, 202 and 203 may automatically connect to each other to form a complete shoe that becomes securely fastened to a user's foot upon connection of panels 201, 202 and 203 to each other.

Referring to FIG. 1, upon complete expansion from sole 200, panel 201 may be automatically connected to panel 202 by the connection of connector 301 to connector 302. Additionally, panel 201 may be automatically connected to panel 203 by the connection of connector 303 to connector 304. Panel 202 may be automatically connected to panel 203 by the connection of connector 306 to connection 305.

Referring to FIG. 1, in an exemplary embodiment of the present invention, in shoe 100 connector panels 301, 302, 303, 304, 305 and 306 may be magnets which automatically connect connector 301 with connector 301; connector 303 with connector 304 and connector 306 with 305. The magnets may have sufficient magnetic strength to secure panels 201, 202 and 203 about a user's foot to allow for safe walking and mobility. However, connectors 301, 302, 303, 304, 305 and 306 could be any type of connector which can automatically secure panels 201, 202 and 203 about a user's foot to allow for safe walking and mobility; such as hooks, clasps, Velcro, electromagnets, reusable adhesives, or the like, which can be used alone or in combination with magnets or similar devices.

Referring to FIG. 1, shoe 100 can be removed in both a manual and hands-free format. Panels 201, 202 and 203 may be completely retracted into sole 200 by being wound up around motors 401, 402 and 403 through the rotation of motors 401, 402 and 403 in a direction opposite to the direction used to expand panels 201, 202 and 203. Motors 401, 402 and 403 are activated in the direction to wind up panels 201, 202 and 203 through one of a plurality of mechanisms. One such mechanism is by depressing retraction button 502. Retraction button 502, shown in FIG. 1, may rests in a recessed pocket on one side of sole 200. Retraction button 502 may be placed anywhere around sole 200. The recessed pocket housing retraction button 502 may be sufficiently deep such that retraction button 502 will not be unintentionally depressed without deliberate intent on the part of the user. Retraction button 502 is sufficiently accessible, such that it can be activated by being depressed by the user's finger. However, retraction button 502 could also be operated in a hands-free format be deliberately pressing the user's shoe against a surface or object with a protrusion that is shaped and dimensioned to reach button 502 within its recessed pocket.

The winding up of panels 201, 202 and 203 around motors 401, 402 and 403 to retract the panels into sole 200, may additionally operate to automatically disconnect panels 201, 202 and 203 from each other.

Referring to FIG. 1, another method for removing shoe 100 by activating motors 401, 402 and 403 in the direction to wind up panels 201, 202 and 203 is through the use of a Smartphone software application which communicates with a wireless receiver positioned in sole 200. This embodiment facilitates hands-free removal of the shoe 100 by the user activating motors 401, 402 and 403 from a Smartphone handset, which wirelessly communicates with Shoe 100.

Referring to FIG. 1, another method for removing shoe 100 by activating motors 401, 402 and 403 in the direction to wind up panels 201, 202 and 203 is through the use of a remote control. This embodiment facilitates hands-free removal of the shoe 100 by the user activating motors 401, 402 and 403 from the remote control, which wirelessly communicates with Shoe 100. The remote control may be sufficiently small that the user could carry it with them at all times in a pocket or about their person. The remote control may be mounted on a wall or near an entranceway to a home, or in another location where a user frequently puts on or removes footwear.

Referring to FIG. 1, motors 401, 402 and 403 may each be powered by one or more batteries which is/are contained within sole 200.

Referring to FIG. 1, the battery or batteries used to power motors 401, 402 and 403 are charged by connecting a power supply through port 503.

Figure 2:
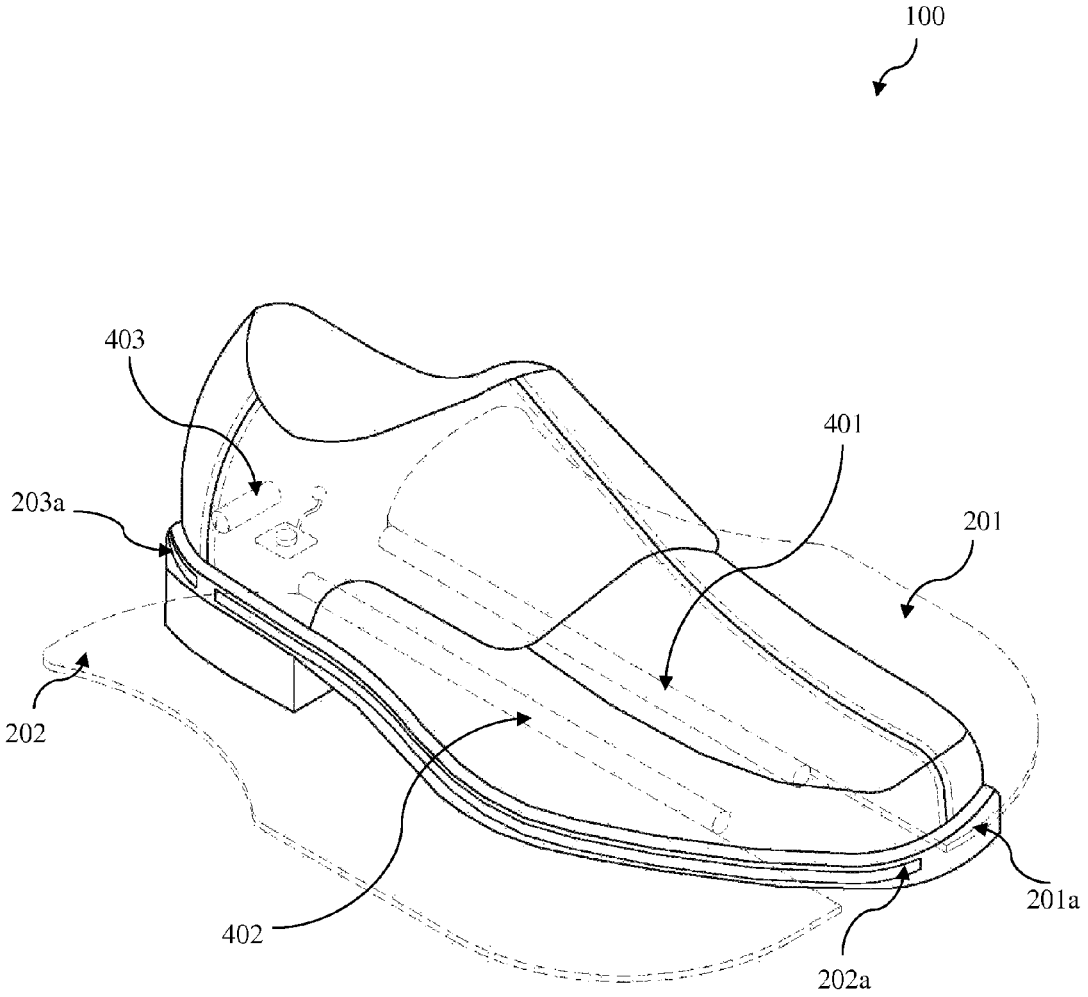
FIG. 2 is a perspective view of an exemplary embodiment of the present invention showing retraction and expansion slits for footwear panels and footwear panels in both partially and fully expanded positions; and a fully assembled shoe.

Referring to FIG. 2, one embodiment of an article of footwear is shown with a perspective view of shoe 100 showing a view of panels 201, 202 and 203 partially extracted from sole 200 and another view of panels 201, 202 and 203 connected to each other to create an exemplary embodiment of an assembled item of footwear.

FIG. 2 is a perspective view of an exemplary embodiment of the present invention showing retraction and expansion slits for footwear panels and footwear panels in both partially and fully expanded positions; and a fully assembled shoe.

Referring to FIG. 2, shoe 100 is additionally show with slits 201*a*, 202*a* and 203*a* visible in sole 200. Slits 201*a*, 202*a* and 203*a* may allow panels 201, 202 and 203 to fully retract inside sole 200 through the rotation of motors 401, 402 and 403.

While slits 201*a*, 202*a* and 203*a* are shown in the sides of sole 200, similar slits may alternatively be placed on the top, outer edge of sole 200, such that panels 201, 202 and 203 would expand in an upward direction our of the sole 200. For example, the positioning of the slits 201*a*, 202*a* and 203*a* on the top of the sole 200 may prevent dirt, mud and other similar debris from entering the sole of the shoe. Alternatively, similarly slits could be placed at any desired angle with respect to sole 200 to guide panels 201, 202 and 203 in a desired direction upon expansion/unwinding out of sole 200. Such alternative slits may be desirable based on the use of different fabric compositions for panels 201, 202 and 203.

Referring to FIGS. 1 and 2, shoe 100 with panels 201, 202 and 203 fully retracted into sole 200, a shoe can be placed about a user's foot without the use of the user's hands by the user positioning their foot in the appropriate position with respect to sole 200 and stepping down onto expansion button 501. Upon pressing button 501, panels 201, 202 and 203 may fully expand from within sole 200 and automatically connect and associate with each other to snuggly fit around the user's foot. A user can then walk about in a normal fashion.

When a user desires to remove shoe 100 in a hands-free format, the user can re-activate motors 401, 402 and 403 to disconnect panels 201, 202 and 203 from each other and retract panels 201, 202 and 203 back into sole 200. Re-activation of motors 401, 402 and 403 may be accomplished through the use of the Smartphone application or a remote control which wirelessly communicates with motors 401, 402 and 403. Alternatively, button 502 can be depressed in either a hands-free or manual format to similarly re-activate motors 401, 402 and 403.

From the foregoing and with reference to the drawings, those skilled in the art will appreciate that certain modifications can also be made to the exemplary embodiments of the present invention without departing from the scope of the same. Therefore, the above descriptions should not be construed as limiting, but merely as exemplifications of particular embodiments.

What is claimed is:

1. An automated shoe closure, comprising:

a sole;

a plurality of panels;

a plurality of motors disposed in the sole, wherein the motors expand or contract one or more of the shoe panels, and wherein the shoe panels each comprise one or more connectors configured to connect the shoe panels to each other when the shoe panels are in an expanded state;

the one or more connectors comprise a magnet configured to connect the one or more connectors to each other;

a plurality of slits disposed in the sole, wherein each of the slits is configured to expand and contract a corresponding shoe panel therethrough;

an expansion button disposed in the sole;

a retraction button disposed in a side of the sole; and a charging port disposed in the sole.

2. The automated shoe closure of claim 1, wherein the motors have a cylindrical shape, and wherein the shoe panels are configured to roll around the motors.

3. The automated shoe closure of claim 1, wherein the motors are configured to be activated simultaneously in response to a wireless signal.

4. The automated shoe closure mechanism of dam 3, wherein the wireless signal is generated from a remote control or a smartphone device.

5. The automated shoe closure of claim 1, wherein the slits are disposed on a top of the sole.

6. The automated shoe closure mechanism of claim 1, wherein the motors are activated by a voice command.

7. An automated shoe closure; comprising:

a sole;

a plurality of panels;

a plurality of motors disposed in the sole, wherein the motors expand or contract one or more of the shoe panels, and wherein the shoe panels each comprise one or more connectors configured to connect the shoe panels to each other when the shoe panels are in an expanded state;

the one or more connectors comprise a magnet configured to connect the one or more connectors each other;

a plurality of slits disposed in a top portion of the sole, wherein each of the slits is configured to expand and contract a corresponding shoe panel therethrough;

an expansion button disposed in the sole;

a retraction button disposed in a side of the sole; and a charging port disposed in the sole.

8. The automated shoe closure of claim 7, wherein the motors have a cylindrical shape, and wherein the shoe panels are configured to roll around the motors.

9. The automated shoe closure of claim 7, wherein the motors are configured to be activated simultaneously in response to a wireless signal.

10. The automated shoe closure mechanism of claim 9, wherein the wireless signal is generated from a remote control or a smartphone device.

11. The automated shoe closure mechanism of claim 7, wherein the motors are activated by a voice command.

12. An article of footwear having an automated closure mechanism, comprising:

a sole;

a plurality of panels;

a plurality of motors disposed in the sole, wherein the motors expand or contract one or more of the shoe panels, and wherein the shoe panels each comprise one or more connectors configured to connect the shoe panels to each other when the shoe panels are in an expanded state;

the one or more connectors comprise a magnet configured to connect the one or more connectors to each other;

a plurality of slits disposed in the sole, wherein each of the slits is configured to expand and contract a corresponding shoe panel therethrough;

an expansion button disposed in the sole;

a retraction button disposed in a side of the sole; and a charging port disposed in the sole.

13. The automated shoe closure of claim 12, wherein the motors have a cylindrical shape, and wherein the shoe panels are configured to roll around the motors.

14. The automated shoe closure of claim 12, wherein the motors are configured to be activated simultaneously in response to a wireless signal.

15. The automated shoe closure mechanism of claim 14, wherein the wireless signal is generated from a remote control or a smartphone device.

16. The automated shoe closure of claim 12, wherein the slits are disposed on a top of the sole.

17. The automated shoe closure mechanism of claim 12, wherein the motors are activated by a voice command.

* * * * *